US009120538B2

(12) United States Patent
Levesque et al.

(10) Patent No.: US 9,120,538 B2
(45) Date of Patent: Sep. 1, 2015

(54) FLEXIBLE JOINT FOR SOLID CARBON RIGGING

(71) Applicant: Hall Spars, Inc., Bristol, RI (US)

(72) Inventors: Peter Levesque, Tiverton, RI (US); Eric Hall, Bristol, RI (US); Thomas Derecktor, Portsmouth, RI (US); Steven J. Winckler, Ballston Spa, NY (US)

(73) Assignee: HALL SPARS, INC., Bristol, RI (US)

( * ) Notice: Subject to any disclaimer, the term of this patent is extended or adjusted under 35 U.S.C. 154(b) by 57 days.

(21) Appl. No.: 13/842,440

(22) Filed: Mar. 15, 2013

(65) Prior Publication Data

US 2013/0255558 A1 Oct. 3, 2013

Related U.S. Application Data

(60) Provisional application No. 61/618,605, filed on Mar. 30, 2012.

(51) Int. Cl.
*B63B 15/02* (2006.01)

(52) U.S. Cl.
CPC ..... *B63B 15/02* (2013.01)

(58) Field of Classification Search
CPC ..... B29C 70/20; B29C 70/56; B63B 15/02; B63H 9/08; B63H 9/10; B63H 11/00
USPC ..... 114/89, 90, 97, 111, 112
See application file for complete search history.

(56) References Cited

U.S. PATENT DOCUMENTS 3,477,402 A * 11/1969 Le Compte ..... 114/89
7,540,250 B2 * 6/2009 Sjostedt et al. ..... 114/111
8,267,027 B2 * 9/2012 Sjostedt et al. ..... 114/111

* cited by examiner

*Primary Examiner* — Lars A Olson
(74) *Attorney, Agent, or Firm* — Pillsbury Winthrop Shaw Pittman, LLP

(57) ABSTRACT

According to an embodiment, a sailboat includes a mast, and a spreader extending from the mast. The sailboat also includes a vertically extending stay spaced from the mast, and a diagonally extending stay coupled to the vertically extending stay and to the mast. The spreader engages the diagonally extending stay at a position above where the diagonally extending stay couples to the vertically extending stay. According to another embodiment, a rigging assembly includes a spreader configured to extend from a mast, a vertically extending stay, and a diagonally extending stay coupled to the vertically extending stay and configured to extend to the mast. The spreader engages the diagonally extending stay at a position above where the diagonally extending stay couples to the vertically extending stay.

23 Claims, 3 Drawing Sheets

FLEXIBLE JOINT FOR SOLID CARBON RIGGING

This application claims benefit under 35 U.S.C. §119(e) to U.S. Provisional Patent Application Ser. No. 61/618,605, filed on Mar. 30, 2012, and incorporated herein in its entirety by reference.

BACKGROUND

This disclosure relates generally to sailboat riggings.

Spars are the poles of a sailboat that generally provide direct or indirect support for the sails. While traditionally formed of wood, and more recently formed of aluminum, the spars (such as a mast, for example) are now often formed of carbon fiber or other composite materials. Such composite materials typically are stronger than wood or metal counterparts, and are of a lighter weight. Additionally, composite materials may be water and corrosion proof, and may perform well under variable loads (e.g., where there is a changing presence or direction of the wind relative to the sail).

The standard rigging of a sailboat generally refers to those elements which support the spars of the sailboat, to handle the forces applied through the sails. In particular, the standard rigging may include wires, cables, lines (e.g., ropes), rods, or other bodies that may be placed under tension to support the spars. Those pieces of standard rigging which hold up the mast are typically referred to as stays. The stays may generally include a forestay, which supports the mast from falling backwards, and a backstay, which supports the mast from falling forward. The stays may also generally include shrouds, which may support the mast from side to side (i.e. in the port/starboard direction).

In some sailboats, shrouds or other stays which support the mast may attach at multiple locations on the mast, or may attach high on the mast. In such sailboats, a spreader may protrude from the mast, to increase the angle of the stay at the attachment point, or support a joint in the stays.

Among other things, the present application discloses improvements to the joints of stays.

SUMMARY

According to an embodiment, a sailboat includes a mast, and a spreader extending from the mast. The sailboat also includes a vertically extending stay spaced from the mast, and a diagonally extending stay coupled to the vertically extending stay and to the mast. The spreader engages the diagonally extending stay at a position spaced above where the diagonally extending stay couples to the vertically extending stay.

According to another embodiment, a rigging assembly includes a spreader configured to extend from a mast, a vertically extending stay, and a diagonally extending stay coupled to the vertically extending stay and configured to extend to the mast. The spreader engages the diagonally extending stay at a position spaced above where the diagonally extending stay couples to the vertically extending stay.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
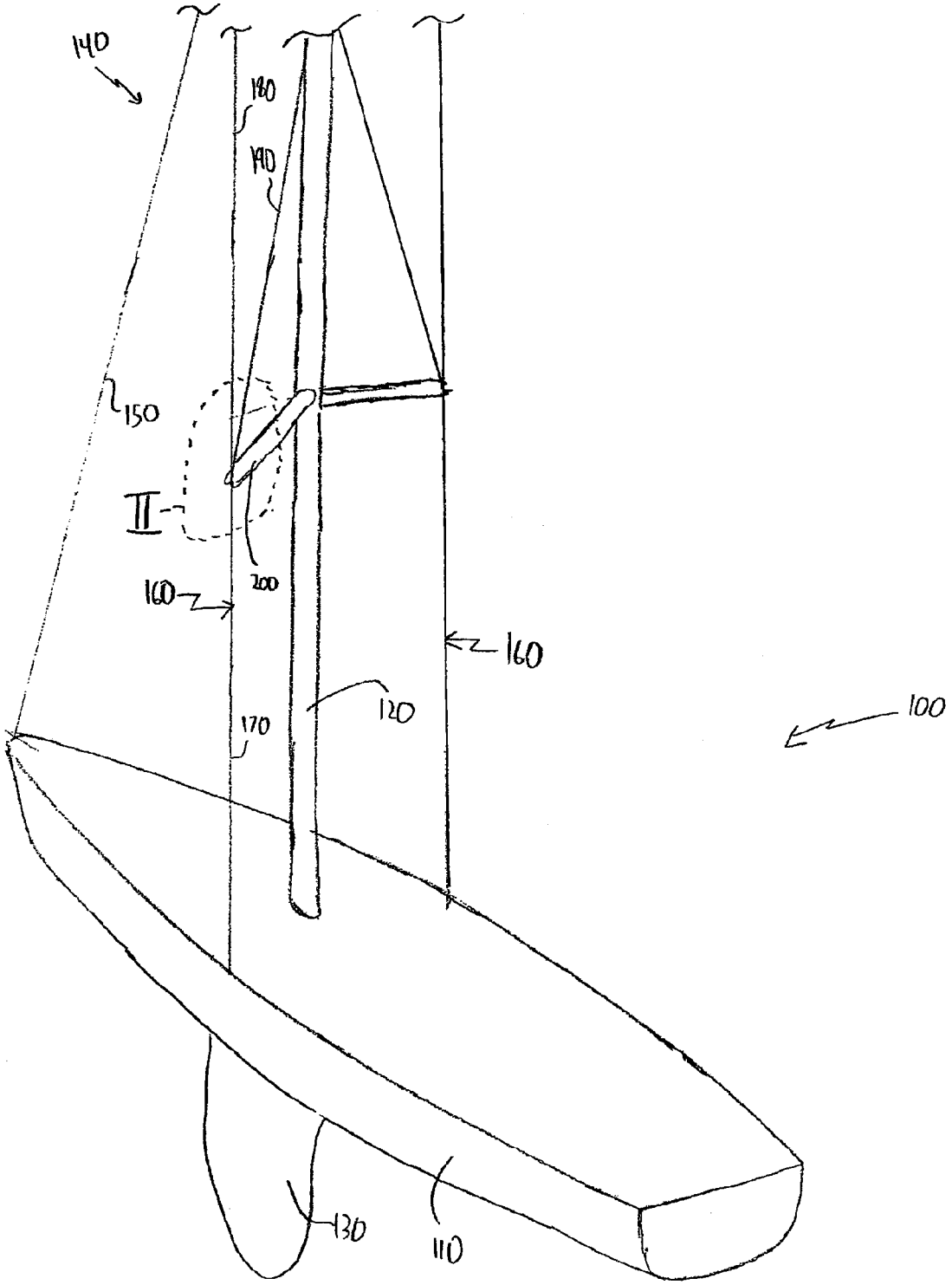
FIG. 1 illustrates a perspective view of an embodiment of a sailboat of the present invention.

FIG. 1 illustrates a sailboat 100. The sailboat 100 includes a hull 110 that may be received in the water, and a mast 120 extending upwards a deck on the hull 110. While in the illustrated embodiment the hull 110 includes a fin keel configuration, with a fin 130 protruding therefrom, it may be appreciated that the hull 110 may be of any appropriate construction or configuration. For example, the hull 110 may comprise wood, metal, carbon fiber, composites, combinations thereof, or any other appropriate material or materials. Additionally, besides for the illustrated fin keel configuration, the hull 110 may alternatively utilize a full keel, a long keel, a twin keel, a winged keel, a bulb keel, or any other appropriate hull configuration. Similarly to the hull 110, the mast 120 may be of any appropriate construction or configuration. For example, in various embodiments the mast 120 may comprise wood, metal, carbon fiber, composites, combinations thereof, or any other appropriate material or materials. Although aluminum is a common metal for the mast 120, other metals are additionally or alternatively possible.

Supporting the mast 120 is rigging 140 which may be under tension by any appropriate mechanism, including but not limited to being coupled to winches, deadeyes, and turnbuckles. In the illustrated embodiment of the sailboat 100, a forestay 150 extends from the hull 110 to the mast 120 (the attachment thereto not being illustrated). Additionally, shrouds 160 extend up to the mast 120. In the illustrated embodiment, each shroud 160 includes a lower vertical stay 170, an upper vertical stay 180, and a diagonal stay 190, described in greater detail below. As additionally described in greater detail below, it may be appreciated that the lower vertical stay 170, the upper vertical stay 180, and the diagonal stay 190 may each comprise carbon fiber or a similar composite fiber, and may be integrally woven together. There may be 3 or more sets of vertical and diagonal stays, and the number illustrated is not intended to be limiting. Additionally, a further diagonal stay (not shown) may extend from an upper end connected to the mast 120 at the spreader 200 to a lower end connected either directly to the hull/deck, or to the lower end portion of the lower vertical stay 170 (in the same manner as the diagonal stay 190's lower end is connection, as is described hereinbelow).

It may be appreciated that the shrouds 160 may vary in size greatly depending on the particular application (e.g., the dimensions of the sailboat 100, and/or the particular stay of the shroud 160). In some embodiments, the shrouds 160 may range in diameter from approximately 2.5 millimeters to approximately 55 millimeters. In an embodiment, the carbon fiber may comprise a pre-impregnated carbon tow (e.g., where the carbon fibers are pre-impregnated with an epoxy or resin) that is less than 1 millimeter in diameter, allowing for a variety of sizes for the shrouds 160. In some embodiments, the shrouds 160 may be configured to generally conform to standard sizes. For example, in one non-limiting embodiment, the shrouds 160 may be sized to behave similarly to those formed from the material marketed as Nitronic 50 stainless steel. Other embodiments may use a dry fiber which is "wetted out" manually for spreader bends, end fittings etc. The invention is not limited to pre-impregnated carbon or any other specific material.

In some embodiments, the lower vertical stay 170, the upper vertical stay 180, and the diagonal stay 190 may each be generally of a similar length. For example, in an embodiment where the lower stay 170 is approximately 5 meters long, the vertical stay 180 and the diagonal stay 190 may both be approximately the same size (e.g., 4.9 meters-5.1 meters). Other sizes, larger or smaller, are also possible. Generally, the lower stay 170, the vertical stay 180, and the diagonal stay 190 may each be approximately 4-12 meters in length.

As shown, the lower stay 170 may extend from the hull 110 upwards towards the top of the mast 120. Between the top of the mast 120 and the hull 110, the lower vertical stay 170 may split into both the upper vertical stay 180, which may continue to extend upwards toward the top of the mast 120, and the diagonal stay 190, which may also extend in a direction towards the top of the mast 120, however at a greater angle into the mast 120. It may be appreciated that in some embodiments the diagonal stay 190 may extend towards the mast 120 at approximately between an 11-25 degree angle relative to the mast 120. In an embodiment, the vertical stays 170, 180 may be generally parallel with the mast (e.g., approximately 85 to 92 degrees relative to the horizon). Accordingly, the lower vertical stay 170 and the upper vertical stay 180 may generally be offset from vertical across numerous embodiments, and the designation of verticality may generally indicate extending more in a vertical direction than the diagonal stay 190.

To separate the lower vertical stay 170, the upper vertical stay 180 and a bottom of the diagonal stay 190 from the mast 120, a spreader 200 may be positioned extending from the mast 120. The spreader 200 may be made of any appropriate construction or configuration with suitable compression properties to support the tension of the shrouds 160. For example, in some embodiments the spreader 200 may be formed of similar material to the mast 120, or other appropriate materials. For example, the spreader 200 may comprise wood, metal (including but not limited to aluminum), carbon fiber, composites, combinations thereof, or any other appropriate material or materials. As shown, an engagement between the spreader 200 and the shroud 160 is highlighted in an enlarged section II, illustrated in FIG. 2. Although not illustrated in FIG. 1.

In some embodiments the upper vertical stay 180 may itself split into another vertical stay and another diagonal stay, thus serving as a lower stay itself. In some embodiments, such a pattern may repeat itself up towards the top of the mast 120. At the uppermost vertical stay (which may be stay 180, or another stay vertically above it), and uppermost spreader and an uppermost diagonal stay are provided in the same manner as stay 190 and spreader 200, except that no further vertical stay extends up from the joint between the uppermost diagonal stay and the uppermost vertical stay.

Figure 2:
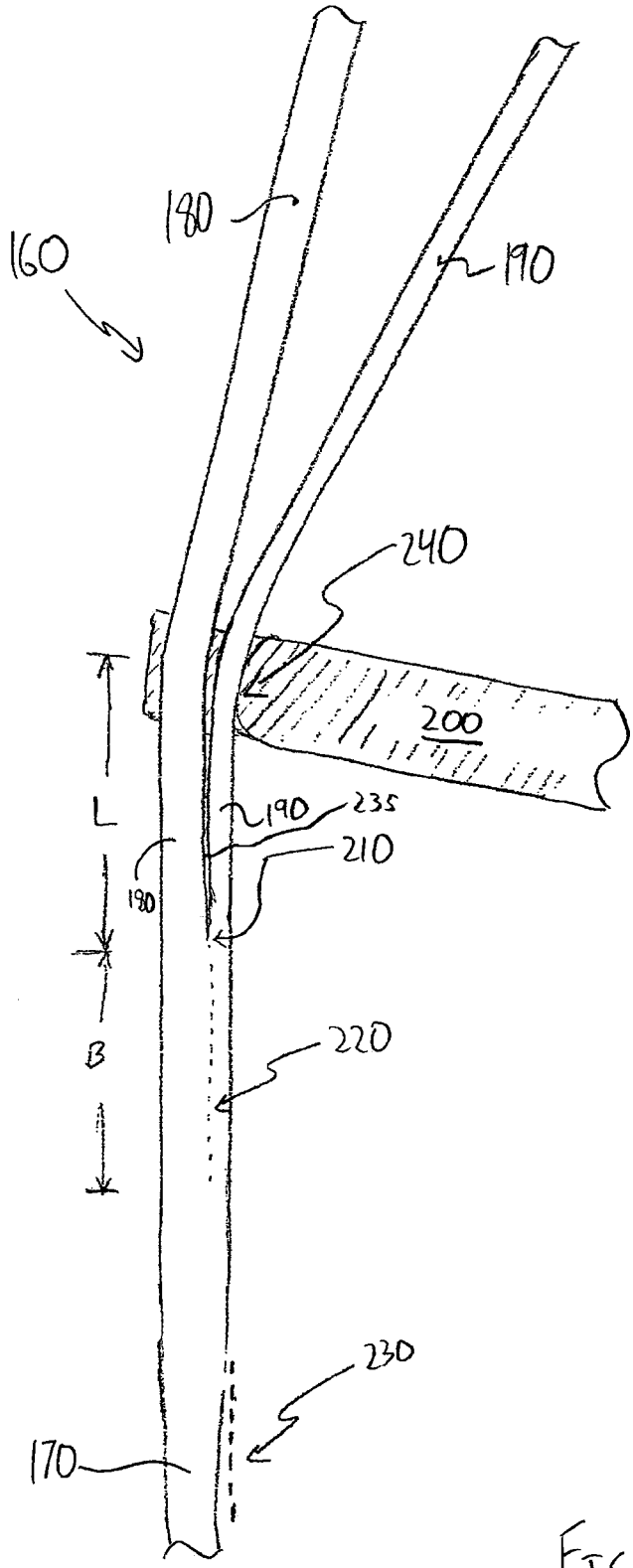
FIG. 2 illustrates an isolated enlarged perspective view of an engagement between a spreader of the sailboat of FIG. 1 and a stay joint according to an embodiment.

As illustrated in the enlarged view of FIG. 2, the upper vertical stay 180 and the diagonal stay 190 may join at a stay joint 210. Additionally, the upper vertical stay 180 and the diagonal stay 190 are configured to remain discrete bodies until joining at the stay joint 210, wherein they are bonded or co-cured together over a bonding length B at a bonding region 220. It may be appreciated that, being formed of carbon fiber, the fibers of the vertical stay 180 and the diagonal stay 190 may become more and more unitary or merged together from the stay joint 210 through the bonding region 220. The bonding region 220 may end where the fibers of the vertical stay 180 and the diagonal stay 190 are no longer distinguishable, at which point the bonding region 220 may taper inwards to form the lower stay 170. As shown in the illustrated embodiment, the tapering of the bonding region 220 into the lower vertical stay 170 may be characterized as occurring at a tapering region 230. It may be appreciated that the bonding length B may vary across embodiments, and in particular may vary with the dimensions of the vertical stay 180 and the diagonal stay 190. For example, where either or both of the vertical stay 180 and the diagonal stay 190 have a thicker diameter, the bonding length B may be greater. It may be appreciated that in an embodiment the length B may be approximately greater than 50 millimeters in length. For example, in an embodiment, the length B may be as great as 500 millimeters in length. It may be appreciated that other embodiments may alternatively include a shorter or longer length B.

As further shown in FIG. 2, the spreader 200 is configured to engage the upper vertical stay 180 and the diagonal stay 190 at a position spaced above the stay joint 210. In FIG. 2, the spreader 200 is shown in cross-section, so as to not obscure the vertical stay 180 and the diagonal stay 190. As shown, a length L may be defined as extending from a center of where the spreader 200 engages the vertical stay 180 and the diagonal stay 190, to where the vertical stay 180 and the diagonal stay 190 begin to join (i.e. the stay joint 210). The length L may vary across embodiments, and in particular may vary with the dimensions of the vertical stay 180 and the diagonal stay 190. For example, where either or both of the vertical stay 180 and the diagonal stay 190 have a thicker diameter, the length L may be greater. As shown, in an embodiment the vertical stay 180 and the diagonal stay 190 may generally diverge at the stay joint 210, defining a gap 235 between the vertical stay 180 and the diagonal stay 190 before a position where the spreader 200 engages the vertical stay 180 and the diagonal stay 190.

It may be appreciated that where the spreader 200 engages the upper vertical stay 180 and the diagonal stay 190 may be considered a bearing region 240 of the spreader 200. While the vertical stay 180 and the diagonal stay 190 are not coupled to the spreader 200 at the bearing region 240, tension on the shrouds 160 may generally hold the vertical stay 180 and the diagonal stay 190 at the bearing region 240, in particular where the bearing region 240 has a notch configuration at a tip of the spreader 200. As a relaxing of the tension may otherwise cause the vertical stay 180 and the diagonal stay 190 to fall out of the notch configuration of the bearing region 240, it may be appreciated that in some embodiments the shroud 160 may be lashed to the spreader 200 (e.g., with rope). In some embodiments, the shroud 160 may be generally encircled by a surrounding portion of the spreader 200 (e.g., where the spreader 200 has an aperture extending therethrough for the shroud 160 to extend along). In some embodiments, an end cap may be rigidly fastened to the spreader 200, which may also create an encircled configuration holding the shroud 160 to the bearing region 240 if tension is relaxed.

It may be appreciated that in conventional riggings, the bearing region of the spreader is positioned at the stay joint, where the vertical stay and the diagonal stay meet. In some such configurations, bending and compressive stresses at the common stay joint and bearing region may result in rig failure, breaking the stay joint and/or the spreader. By creating a length L of separate vertical stay 180 and diagonal stay 190 below the spreader 200 (e.g., below the bearing region 240), the vertical stay 180 and the diagonal stay 190 may be discrete bodies above, at, and immediately below the spreader 200. Such a configuration may allow the upper vertical stay 180 and the diagonal stay 190 the ability to flex in relation to one another at the bearing region 240, which may reduce fatigue, wear, and/or stress thereat. It may be appreciated that the freedom of the upper vertical stay 180 and the diagonal stay 190 to flex in relation to the lower vertical stay 170 and/or the spreader 200 may allow the vertical stay 180 and the diagonal stay 190 to have a leaf-spring configuration. Accordingly, over the length L, the vertical stay 180 and the diagonal stay 190 may be allowed to move and stretch independently. The vertical stay 180 and the diagonal stay 190 may additionally rub and bear on each other. In some embodiments, a resilient material, such as rubber or silicone, may be added along the length L, wherever the separate vertical stay 180 and diagonal stay 190 may contact one another under tension, to prevent damage from friction therebetween. It may be appreciated that the length L may vary across embodiments. In an embodiment, the length L may be approximately 60 millimeters or greater. In embodiments where the diagonal stay 190 has a diameter of approximately 9 millimeters or more, the length L may increase by the same amount as the diameter of the diagonal stay 190.

Figure 3:
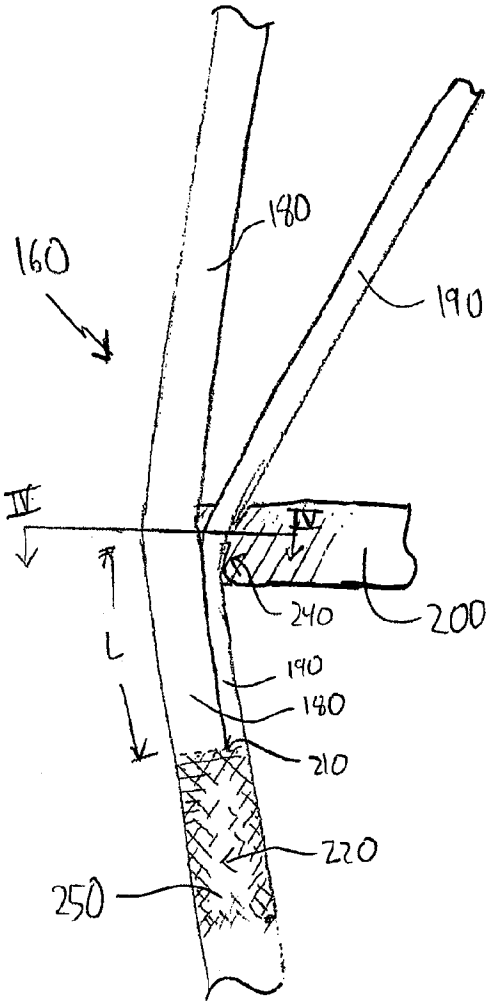
FIG. 3 illustrates an isolated enlarged perspective view of an engagement between a spreader of and a stay joint according to another embodiment.

FIG. 3 depicts a similar embodiment to the engagement of FIG. 2 between the upper vertical stay 180, the diagonal stay 190, and the spreader 200. Again, the spreader 200 is shown in cross-section, so as to not obscure the vertical stay 180 and the diagonal stay 190. As shown, in an embodiment the vertical stay 180 and the diagonal stay 190 may generally extend parallel to one another, as separate bodies, until passing the bearing region 240, at which point the upper vertical stay 180 and the diagonal stay 190 may diverge. As further shown in FIG. 3, in an embodiment the bonding region 220, positioned spaced from the spreader 200 and the bearing region 240 by the length L, may be wrapped in an overwrap material 250. It may be appreciated that the overwrap material may be configured to aid in load transfer and load sharing from the vertical stay 180 and the diagonal stay 190 to the lower vertical stay 170, and vice versa. In an embodiment, the overwrap material 250 is formed of carbon fiber, or another composite fiber medium.

In an embodiment, the length of the overwrap material 250 may depend on how much material is being tapered. For example, if the size of the vertical stay 180 is approximately the same as the size of the lower stay 170, then the diagonal stay 190 would be tapered. Conversely, in some embodiments, if the vertical stay 180 and the diagonal stay 190 are close in size, then only a small amount of material may be tapered. Regardless of the amount of material tapered, however, it may be appreciated that in some embodiments the overwrap material 250 may approximately 0.4 millimeters or more. In some embodiments, the overwrap material may be approximately 1 millimeter thick. It may be appreciated that thicker or thinner implementations of the overwrap material 250 may alternatively be utilized. In an embodiment, the length of the overwrap material 250 may vary depending on the implementation. For example, in an embodiment the overwrap material 250 may be approximately 150 millimeters long. In some embodiments, a longer amount of the overwrap material 250 may alternatively be utilized. For example, in an embodiment the overwrap material may be as long as 1000 millimeters. It may be appreciated that longer or shorter implementations of the overwrap material 250 may alternatively be utilized.

It may be appreciated that in an embodiment the overwrap material 250 may be configured as a structural overwrap, which may participate in the load bearing and force transferring properties of the shroud 160. In other embodiments, however, the overwrap material 250 may be omitted, or may be configured with a looser configuration (e.g., a configuration that does not participate in load bearing or force-transferring properties for the shroud 160). While in some embodiments the overwrap material may extend above the stay joint 210, it may be appreciated that the overwrap material 250 may generally not extend into the bearing region 240. Additionally, in some embodiments the overwrap material 250 may extend into the tapering region 230, however would generally not extend further towards the lower stay 170 than is functionally beneficial.

Figure 4:
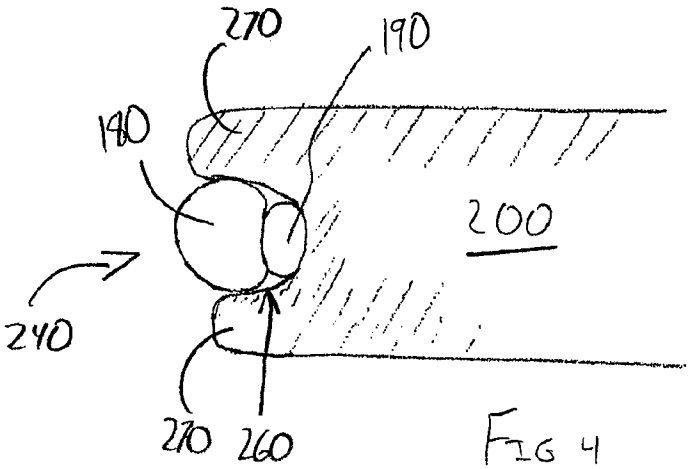
FIG. 4 illustrates a sectional view of the spreader and stays of the stay joint of FIG. 3.

Further illustrated in FIG. 3 is a section line IV, which shows a cross section depicted in FIG. 4. As shown in the view of FIG. 4, the spreader 200 may include a notch 260 at an end thereof, distal from the mast 120. It may be appreciated that the notch 260 may be of any appropriate size, and in an embodiment may have a diameter sufficiently large to fully encompass the diagonal stay 190, and at least partially encompass the vertical stay 180. In an embodiment, the notch 260 may generally be approximately as wide as the diameter of the combined vertical stay 180 and diagonal stay 190, to limit side to side movement thereof within the notch 260. Additionally, in some embodiments, the notch 260 may generally be approximately as deep as the diameter of the combined vertical stay 180 and diagonal stay 190. While in some embodiment flanged portions 270 of the spreader 200 defining the notch 260 may extend around the vertical stay 180, it may be appreciated that the flanged portions 270 may generally extend substantially around the diagonal stay 190, which may utilize the coupling to the vertical stay 180 at the stay joint 210, and the tension across the shroud 160, to prevent the vertical stay 180 from generally falling away from the notch 260.

It may be appreciated that while the illustrated embodiment depicts the vertical stay 180 and the diagonal stay 190 extending above, at, and below the spreader 200, such a configuration may be utilized when joining any number of tension cables, or when joining the rigging 140 to any spar, and/or to the hull 110.

Aspects and implementations may be described in the above disclosure as including particular features, structures, or characteristics, but it will be apparent that every aspect or implementation may or may not necessarily include the particular features, structures, or characteristics. Further, where particular features, structures, or characteristics have been described in connection with a specific aspect or implementation, it will be understood that such features, structures, or characteristics may be included with other aspects or implementations, whether or not explicitly described. Thus, various changes and modifications may be made to the preceding disclosure without departing from the scope or spirit of the inventive concept, and the specification and drawings should therefore be regarded as exemplary only, with the scope of the invention determined solely by the appended claims.

What is claimed is:

1. A sailboat comprising;

a mast;

a spreader extending from the mast;

a composite fiber vertically extending stay spaced from the mast; and a composite fiber diagonally extending stay coupled to the vertically extending stay and to the mast;

wherein the vertically extending stay and the diagonally extending stay are bonded or cured together at a stay joint, wherein the spreader engages the diagonally extending stay at a position that is spaced above where the diagonally extending stay is bonded or cured to the vertically extending stay, and wherein the vertically extending stay and the diagonally extending stay are split from one another in a region after the stay joint and before the position at which the spreader is engaged.

2. The sailboat of claim 1, wherein the vertically extending stay and the diagonally extending stay are formed of carbon fiber.

3. The sailboat of claim 1, further comprising a bonding region below the stay joint, the bonding region comprising material from the vertically extending stay interwoven with material from the diagonally extending stay.

4. The sailboat of claim 3, further comprising overwrap material surrounding the bonding region.

5. The sailboat of claim 4, wherein the overwrap material comprises carbon fiber.

6. The sailboat of claim 1, wherein the spreader comprises a notch configured to engage the diagonally extending stay and at least partially surround the vertically extending stay.

7. The sailboat of claim 6, wherein the diagonally extending stay and the vertically extending stay are secured to the notch by an end cap.

8. The sailboat of claim 1, further comprising a resilient material between a portion of the vertically extending stay and a portion of the diagonally extending stay, below a position where spreader engages the diagonally extending stay.

9. The sailboat of claim 8, wherein the resilient material comprises rubber or silicone.

10. A rigging assembly comprising;

a spreader configured to extend from a mast;

a composite fiber vertically extending stay; and a composite fiber diagonally extending stay coupled to the vertically extending stay and configured to extend to the mast;

wherein the vertically extending stay and the diagonally extending stay are bonded or cured together at a stay joint;

wherein the spreader engages the diagonally extending stay at a position spaced above where the diagonally extending stay couples to the vertically extending stay, and wherein the vertically extending stay and the diagonally extending stay are split from one another in a region after the stay joint and before the position at which the spreader is engaged.

11. The rigging assembly of claim 10, wherein the vertically extending stay and the diagonally extending stay are formed of carbon fiber.

12. The rigging assembly of claim 10, further comprising a resilient material between a portion of the vertically extending stay and a portion of the diagonally extending stay, below a position where spreader engages the diagonally extending stay.

13. The rigging assembly of claim 10, further comprising a bonding region below the stay joint, the bonding region comprising material from the vertically extending stay interwoven with material from the diagonally extending stay.

14. The rigging assembly of claim 13, further comprising overwrap material surrounding the bonding region.

15. The rigging assembly of claim 14, wherein the overwrap material comprises carbon fiber.

16. The sailboat of claim 1, further comprising a gap between the vertically extending stay and the diagonally extending stay that extends from the region before the position at which the spreader is engaged and after the stay joint.

17. The rigging assembly of claim 10, further comprising a gap between the vertically extending stay and the diagonally extending stay that extends in the region before the position at which the spreader is engaged and after the stay joint.

18. A composite fiber rigging assembly comprising:

a lower stay; and a spreader configured to extend from a mast;

wherein the lower stay is split into a vertically extending stay and a diagonally extending stay, the diagonally extending stay being coupled to the vertically extending stay and the mast;

wherein the vertically extending stay and the diagonally extending stay are coupled together at a stay joint;

wherein the spreader engages the diagonally extending stay at a bearing region spaced a distance above the stay joint; and wherein the vertically extending stay and the diagonally extending stay diverge relatively away from each other and are configured to flex relative to each other at the bearing region as well as configured to flex relative to the lower stay and/or the spreader.

19. The composite fiber rigging assembly of claim 18, further comprising a bonding region below the stay joint and adjacent the lower stay, the bonding region comprising material from the vertically extending stay interwoven with material from the diagonally extending stay.

20. The composite fiber rigging assembly of claim 19, wherein the bonding region further comprises a tapering region that tapers inwards to form the lower stay.

21. The composite fiber rigging assembly of claim 19, further comprising overwrap material surrounding at least a portion of the bonding region.

22. The composite fiber rigging assembly of claim 18, wherein the spreader comprises flanged portions spaced relative to one another that form a substantially circular notch, the notch comprising a diameter configured to encompass the diagonally extending stay and at least partially compass the vertically extending stay, so as limit relative movement of the stays.

23. The composite fiber rigging assembly of claim 18, further comprising a gap between the vertically extending stay and the diagonally extending stay that extends in a region extending between the stay joint and bearing region.

* * * * *